United States Patent [19]

Magnuson

[11] 4,440,061

[45] Apr. 3, 1984

[54] GUN TRAVERSE APPARATUS

[75] Inventor: Roland A. Magnuson, Seattle, Wash.

[73] Assignee: PACCAR Inc., Bellevue, Wash.

[21] Appl. No.: 255,359

[22] Filed: Apr. 20, 1981

[51] Int. Cl.[3] ..... F41G 5/04

[52] U.S. Cl. ..... 89/41 H; 89/37 E

[58] Field of Search ..... 89/37 E, 37 G, 41 H, 89/41 R, 41 M, 41 T

[56] References Cited

U.S. PATENT DOCUMENTS

| | | | |
|---|---|---|---|
| 3,550,300 | 12/1970 | Roder | 89/41 A |
| 3,956,965 | 5/1976 | Rusbach | 89/41 A |
| 4,223,591 | 9/1980 | Croissant, Jr. | 89/37.5 C |
| 4,273,026 | 6/1981 | Walter | 89/37.5 C |

FOREIGN PATENT DOCUMENTS

| | | | |
|---|---|---|---|
| 1493632 | 11/1977 | United Kingdom | 89/37 E |

*Primary Examiner*—Donald P. Walsh
*Assistant Examiner*—Maureen T. Ryan
*Attorney, Agent, or Firm*—Seed and Berry

[57] ABSTRACT

A gun traverse apparatus in which the trunnions are mounted in eccentrics which are simultaneously rotated in opposite directions to swing the gun horizontally in limited traverse relative to the carrier on which the gun is mounted. In one embodiment, the carrier is a mobile carrier provided with a transmission for steering, and a signal is transmitted from the gun at the limit of the traverse to actuate the transmission and turn the vehicle further to bring the gun traverse back into its range of movement.

8 Claims, 4 Drawing Figures

GUN TRAVERSE APPARATUS

DESCRIPTION

1. Technical Field

This invention pertains to gun mounts for weapons and, in particular, gun mounts for providing additional traverse capability independent of the carrier upon which the gun is mounted.

2. Background Art

In recent years, self-propelled guns have been developed that do not employ a rotating turret. These vehicles traverse the guns by turning the entire vehicle on its tracks. This is done by utilizing the hydrostatic, infinitely variable steering system in the automotive transmission. These weapons, however, have the disadvantage of having only a limited range of traverse where the terrain conditions are difficult to maneuver. Furthermore, they can dig themselves into a hole if firing numerous rounds from a single position.

Techniques have been developed to give the gun a traverse independent of the position of the vehicle. Typical of these devices are spherical balls, the conventional turret, and a U-gimbaled mount for the gun. All of these mechanisms have various problems, in some cases being very heavy, and in the case of the U-joint gimbal, lacking the ability to transfer the reaction force upon firing a round directly to the trunnions which support the gun on the carrier.

DISCLOSURE OF THE INVENTION

It is an object of this invention to provide a limited traverse capability to the gun relative to the carrier of the gun for increasing the field of fire available to the weapon.

It is another object of this invention to provide a traverse apparatus which transfers the reaction load upon firing a round directly to the trunnions which support the gun.

It is another object of this invention to provide a simple, lightweight gun traverse apparatus for traversing the gun relative to the carrier.

Basically, these objects are obtained by mounting the gun trunnions in eccentrics which can be simultaneously pivoted in opposite directions to slew or traverse the gun relative to the carrier upon which the trunnions are mounted. In the case of a mobile carrier, the position of the gun as traversed by the eccentrics will signal to the hydrostatic steering system in the transmission to change the carrier position when the traverse from the eccentric trunnions is reaching the limits of its capability. The apparatus is very lightweight since it takes advantage of the use of the readily available trunnion elevation mounting members and adds little additional structure which would increase the weight of the weapon.

BEST MODE FOR CARRYING OUT THE INVENTION

Figure 1:
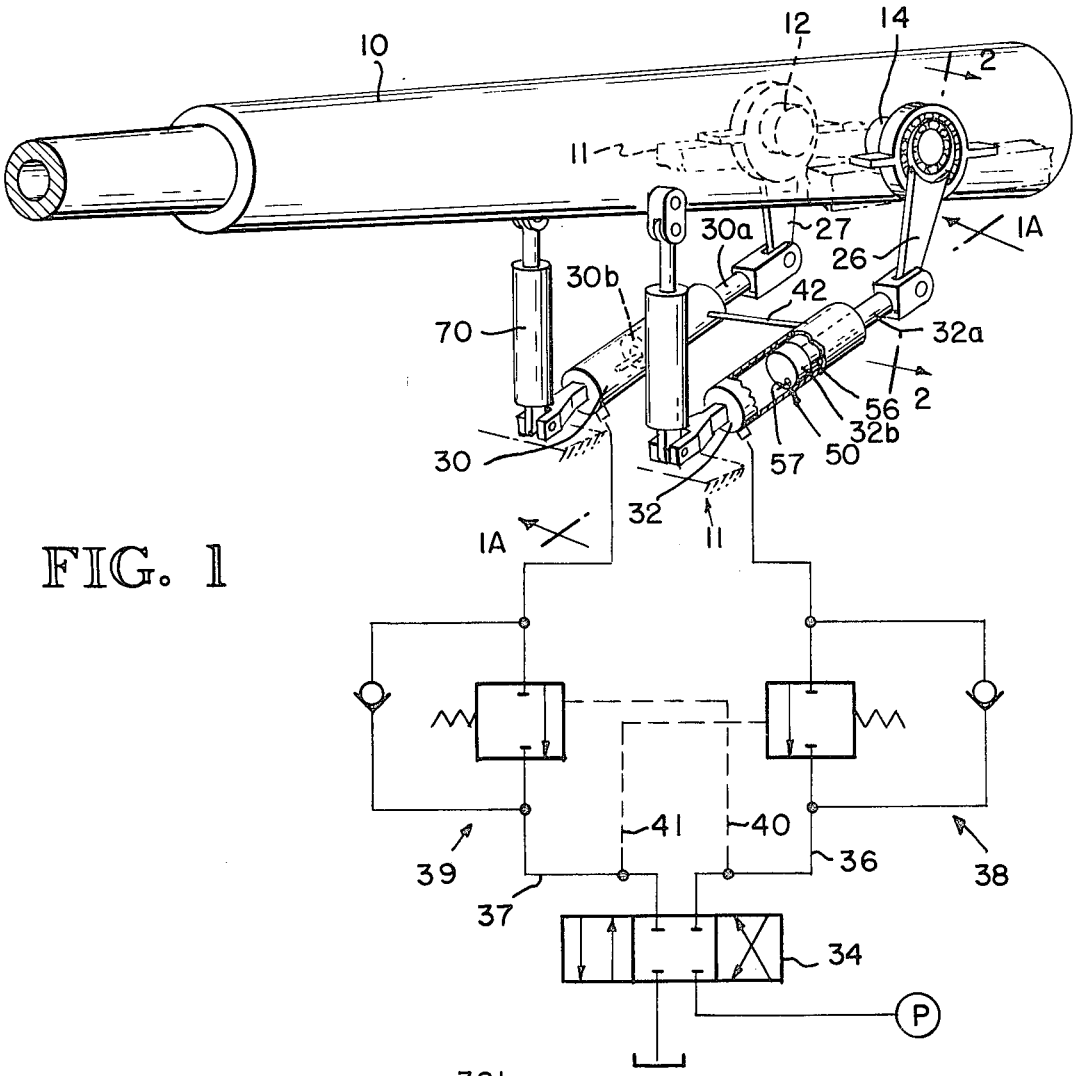
FIG. 1 is a schematic illustration of a gun traverse apparatus embodying the principles of the invention.

As best shown in FIG. 1, a gun 10 is mounted on a carrier 11 of any conventional kind, such as a Swedish S-tank or the West German casement tank, which are typical. The gun could also be mounted on an immobile carrier.

The gun is provided with trunnions or pivots 12 and 14 each of which is secured to the carrier so the gun can be rotated about a common gun axis GA. The trunnions are each rotatably mounted in bearings 16 and are essentially identical. Accordingly, the details of only one trunnion and its mounting will be described.

An eccentric 18 includes an eccentric plate 20 which is mounted in an outside bearing 22. The center of rotation of the eccentric plate is about an eccentric axis EA which is offset from the gun axis GA. The eccentric axis of each trunnion is offset equally in the same direction, and thus the axes are aligned with one another. The outer race of the bearing 22 is mounted in a housing 24 which is fixed to the frame of the carrier. The eccentric plate 20 is then coupled to an eccentric arm 26.

The gun axis lies below the eccentric axis. When the eccentric arm of each eccentric is rotated in equal but opposite directions, the eccentrically between the two axes EA and GA causes the gun to traverse or skew in a horizontal direction. The traverse capability is about five degrees in each direction, giving a ten degree range of traverse relative to the carrier, which equates to approximately 52 seconds of tracking a crossing target, traveling 30 miles an hour at a distance of 4,000 meters.

The eccentric axes could be offset in opposite directions if desired and suitable control changes were made to accommodate the different motions required to produce skewing of the trunnions. Cylinders 70 provide vertical positioning of the gun 10 in a conventional manner.

The control system for operating the eccentric arms is best shown in FIG. 1 and includes an actuator or cylinder 30 and an actuator or cylinder 32. The actuator 30 has a piston rod **30*a* and piston 30*b* coupled to eccentric arm 27, whereas the other actuator has a piston rod 32*a* and piston 32*b* coupled to the other eccentric arm 26. A traverse control valve 34 is a three-position valve having a line 36 which connects to a one-way lock valve 38 and a line 37 which connects to a second one-way lock valve 39. The lock valves are conventional and are operated from pilot pressure lines 40 and 41. Shifting of the traverse control valve in one direction will introduce fluid through line 36 through the flow control valve 38 to the actuator 32 to rotate the eccentric arm 26 in a counterclockwise direction. The fluid in the opposite rod end of the actuator flows out of actuator 32 through a common line 42 to the rod end of the actuator 30. This drives the eccentric arm 27 in a clockwise direction, as viewed in FIG. 1, that is, in a reverse direction to eccentric arm 26. Fluid in the head end of the actuator 30 flows through the flow control valve 39, which does not open until the pressure in pilot line 40** exceeds a desired amount so that the eccentrics must always be operated against a back pressure or a power-driven mode.

Preferably, the recoil force of the round on the gun 10 will be transferred directly to the trunnion and thus to the frame via the bearings 16 and 22. This advantageously reduces the amount and size of structure otherwise necessary to transmit the recoil force to the frame.

Since the gun axis is below the eccentric axis, the recoil force on the trunnions will cause both eccentric arms to attempt to pivot counterclockwise. The control circuit, as shown, is arranged to transfer this force to the rod ends of the actuators. This in effect dead-ends the fluid flow so that the force reacts against rigid piston rods due to the incompressibility of the fluid. As an alternative, the eccentric and gun axes could be reversed in their relative positions and the lines from the control valve located at the rod ends of the actuators.

Figure 1A:
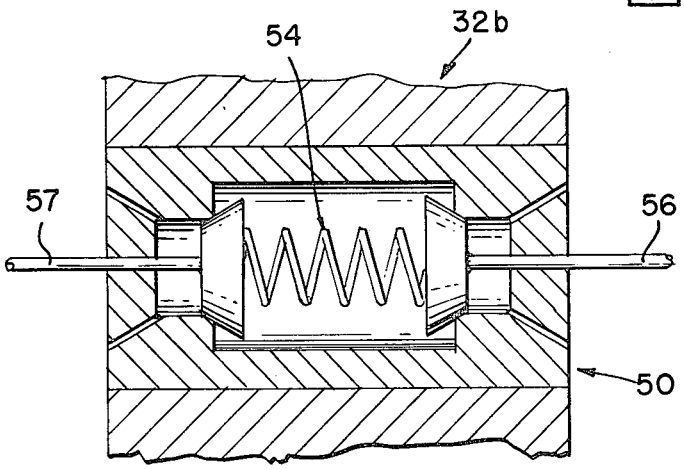
FIG. 1A is a detail of a valve used in the control system for the traverse apparatus.
Figure 2:
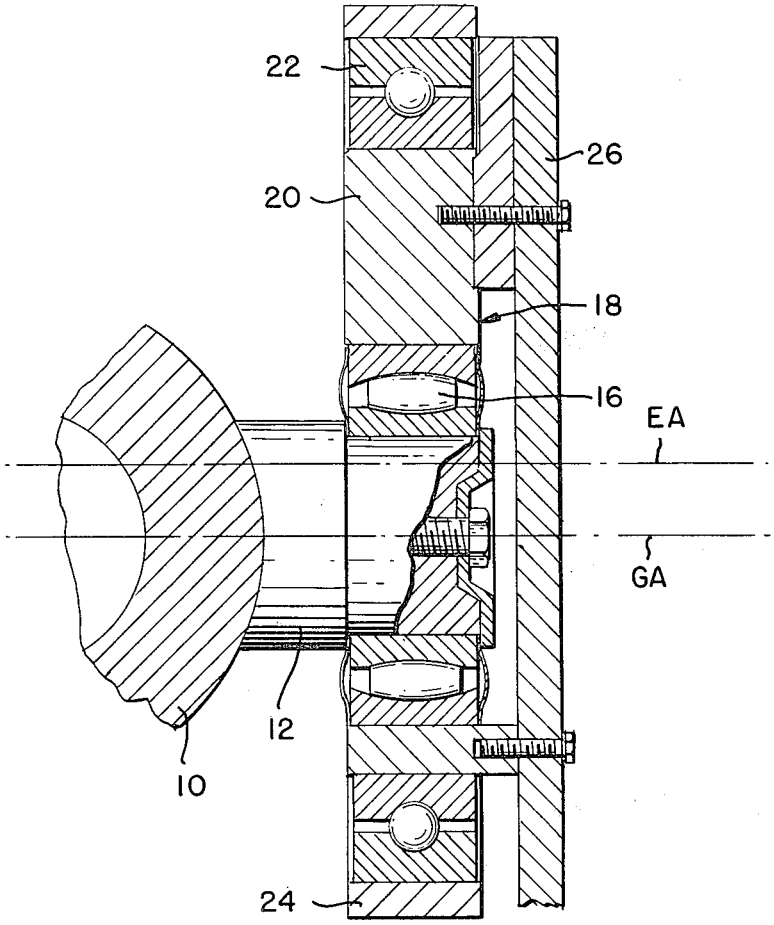
FIG. 2 is a fragmentary transverse section through a portion of the carrier embodying the principles of the invention.

In order to initially synchronize or align the relative positions of the pistons within their actuators 30 and 32, at least one, but preferably two, synchronizing valve 50 are positioned in the pistons. A typical synchronizing valve is shown in FIG. 1A and includes, as an example, valves 56 and 57 pushed closed by a central spring 54. In operation, when the first piston bottoms out in either direction prior to the piston in the opposite actuator, one of the rods 56 or 57 is depressed, allowing flow to pass through the piston until the opposite piston rod also bottoms out. In this condition then, both of the pistons are in alignment with one another but at opposite ends of their respective actuators and henceforth will operate in synchronism with one another.

Figure 3:
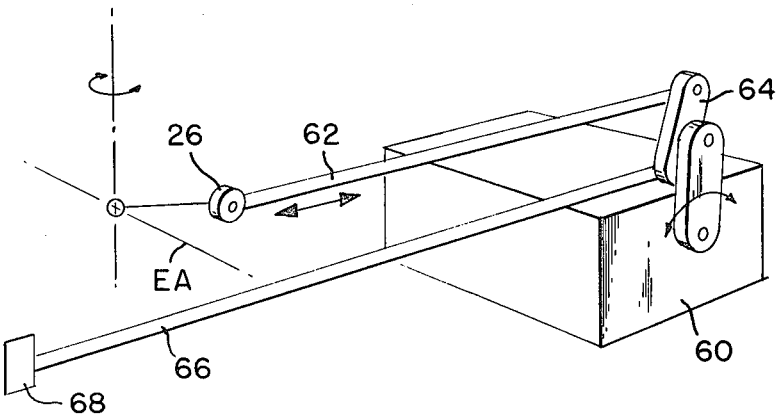
FIG. 3 is a schematic illustration of a steering system control for mobile carriers embodying the invention.

While the apparatus above-described is also suitable for stationary carriers, it is best suited and most advantageously employed for mobile carriers, preferably of the type in which steering of the vehicle is through a conventional hydrostatic steering system 60 (FIG. 3). The steering system 60 controls the automotive transmission for controlling the tracks of the vehicle. It is understood, of course, that traversing by the above-described traverse apparatus is limited in distance to about ten degrees full traverse. Thus, as the target begins to leave the traverse capability of the trunnion traverse system, a signal is given to the hydrostatic steering system 60 to reposition the carrier so that it brings the gun back into the eccentric traverse capability. This signal can be accomplished several ways, either mechanically, hydraulically, or electrically. A preferred mechanical configuration is best shown schematically in FIG. 3 and includes a link 62 which is coupled to an eccentric arm and to a valve operator 64 in the steering system. Another rod 66 is connected to the driver-operated steering input station 68 for manually overriding the automatic system. Thus, as is well understood, by movement of the gun in traverse to its limit, the link 62 then signals through the valve operator 64 to the transmission to begin a turn of the carrier in that same direction.

While the preferred embodiment of the invention has been illustrated and described, it should be understood that variations will be apparent to one skilled in the art without departing from the principles described herein. Accordingly, the invention is not to be limited to the specific embodiment illustrated in the drawings.

I claim:

1. Gun traverse apparatus for a weapon of the type having a mobile carrier having ground-engaging support means and a gun mounted for elevation about a gun pivot axis and traverse relative to the carrier, said carrier being of the type having controlled transmission means for moving the carrier ground-engaging support means to position the carrier, the improvement comprising:

gun positioning means on said carrier for positioning the gun relative to the carrier through a limited angle between two set limits of traverse, means for controlling the transmission means for maneuvering the carrier into a new position, and coupling means operatively associated with the gun positioning means and the transmission means controlling means for signaling the means controlling the transmission means when the gun reaches one of said set limits to automatically reposition the carrier in the direction of gun movement as the gun reaches the limit of its traverse relative to the carrier to restore the gun into the range of the gun positioning means.

2. The apparatus of claim 1, said gun positioning means including opposed trunnions supporting the gun on the carrier, said trunnions being mounted in laterally spaced eccentrics which rotate about horizontal eccentric pivot axes offset from the gun pivot axis, said gun positioning means including means for simultaneously pivoting said eccentrics in equal and opposite directions for pivoting said gun in traverse relative to said carrier about a vertical pivot axis.

3. The apparatus of claim 2, said transmission means being hydrostatic transmission means having a control member, and said coupling means including a link joined to one of said eccentrics and to said control member whereby the movements of the eccentric are directly transmitted to said transmission means control member.

4. The apparatus of claim 1, said transmission means being hydrostatic transmission means having a control member, and said coupling means including a link joined to one of said eccentrics and to said control member whereby the movements of the eccentric are directly transmitted to said transmission means control member.

5. Gun traverse apparatus for a weapon of the type having a carrier and a gun mounted for elevation and traverse on said carrier, comprising:

said gun having opposed trunnions supported on said carrier for elevation positioning about a horizontal gun pivot axis, said trunnions being mounted in laterally spaced eccentrics which rotate about horizontal eccentric pivot axes offset from said gun pivot axis, and gun traverse control means for simultaneously rotating said eccentrics in equal and opposite directions for pivoting said gun in traverse relative to said carrier about a vertical pivot axis, said carrier being a mobile carrier and including means for controlling the direction of movement of said carrier, including secondary control means responsive to traverse movement of the gun relative to the carrier for operating the carrier directional control means when a predetermined limit of traverse is reached by said gun.

6. The apparatus of claim 5, said carrier directional control means including transmission means having an input control, said secondary control means including linkage means operatively coupling said gun traverse movement to said transmission input control whereby the movement of the gun through the predetermined limit of traverse will operate the transmission and move the carrier for additional traverse.

7. Gun traverse apparatus for a weapon of the type having a carrier and a gun mounted for elevation and traverse on said carrier, comprising:

said gun having opposed trunnions supported on said carrier for elevation positioning about a horizontal gun pivot axis, said trunnions being mounted in laterally spaced eccentrics which rotate about horizontal eccentric pivot axes offset from said gun pivot axes, and gun traverse control means for simultaneously rotating said eccentrics in equal and opposite directions for pivoting said gun in traverse relative to said carrier about a vertical pivot axis, said gun traverse control means including a traverse control valve, a separate hydraulic actuator and piston coupled to each eccentric and to said traverse control valve, lock valves between the traverse control valve and said actuators for maintaining a predetermined hydraulic pressure on said actuators, and a synchronizing valve for at least one actuator to allow flow to bypass a piston until the pistons in each actuator become similarly aligned in their actuators.

8. Gun traverse apparatus for a weapon of the type having a carrier and a gun mounted for elevation and traverse on said carrier, comprising:

said gun having opposed trunnions supported on said carrier for elevation positioning about a horizontal gun pivot axis, said trunnions being mounted in laterally spaced eccentrics which rotate about horizontal eccentric pivot axes offset from said gun pivot axis, and gun traverse control means for simultaneously rotating said eccentrics in equal and opposite directions for pivoting said gun in traverse relative to said carrier about a vertical pivot axis, said actuators each coupled to said traverse control valve at a first end and coupled to each other at an opposite second end, and means coupling said actuators to said eccentrics for providing the gun reaction force from firing to piston movement toward compression of fluid toward said actuator second ends whereby the fluid does not transmit the force to the traverse control valve.

* * * * *